United States Patent [19]

Curtis et al.

[11] Patent Number: 4,625,437

[45] Date of Patent: Dec. 2, 1986

[54] SHROUD FOR A DIGGING BUCKET LIP

[75] Inventors: Linden T. Curtis, Temecula, Calif.; William G. Franklin, Tucson, Ariz.; John R. Olds, Schererville, Ind.

[73] Assignee: Engineered Equipment Company, Corona, Calif.

[21] Appl. No.: 723,206

[22] Filed: Apr. 15, 1985

[51] Int. Cl.[4] ..... E02F 9/28

[52] U.S. Cl. ..... 37/141 R; 172/745; 228/138; 228/165; 403/272

[58] Field of Search ..... 37/141 R, 141 T, 142 R; 172/745; 228/165, 168, 138; 403/271, 272

[56] References Cited

U.S. PATENT DOCUMENTS

| | | | |
|---|---|---|---|
| 3,095,951 | 7/1963 | Rood et al. | 403/272 |
| 3,914,885 | 10/1975 | Moreau | 37/141 R |
| 4,238,896 | 12/1980 | Lanz et al. | 37/141 R |
| 4,317,299 | 3/1982 | Funk | 37/141 T |
| 4,414,764 | 11/1983 | Johansson et al. | 37/141 T |

*Primary Examiner*—Edgar S. Burr
*Assistant Examiner*—Moshe I. Cohen
*Attorney, Agent, or Firm*—Lothrop & West

[57] ABSTRACT

A digging bucket lip is provided with one or more shrouds, each shroud having a blunt forward portion and a rearward portion divided into two spaced-apart legs. There are apertures through the legs, preferably in alignment. Rings are slidably disposed in the apertures and are welded on their inner margins to the lip disposed between the legs.

6 Claims, 5 Drawing Figures

SHROUD FOR A DIGGING BUCKET LIP

BRIEF SUMMARY OF THE INVENTION

A shroud for use with a digging bucket lip has an integral body with a rounded forward portion and a divided rearward portion affording two parallel legs adapted to receive a part of the lip between them. Apertures through the legs each slidably receive a ring welded on its inner wall to the lip.

PRIOR ART

No particularly pertinent prior art is known to the applicants.

BRIEF DESCRIPTION OF THE SEVERAL VIEW OF THE DRAWINGS

DETAILED DESCRIPTION

Figure 1:
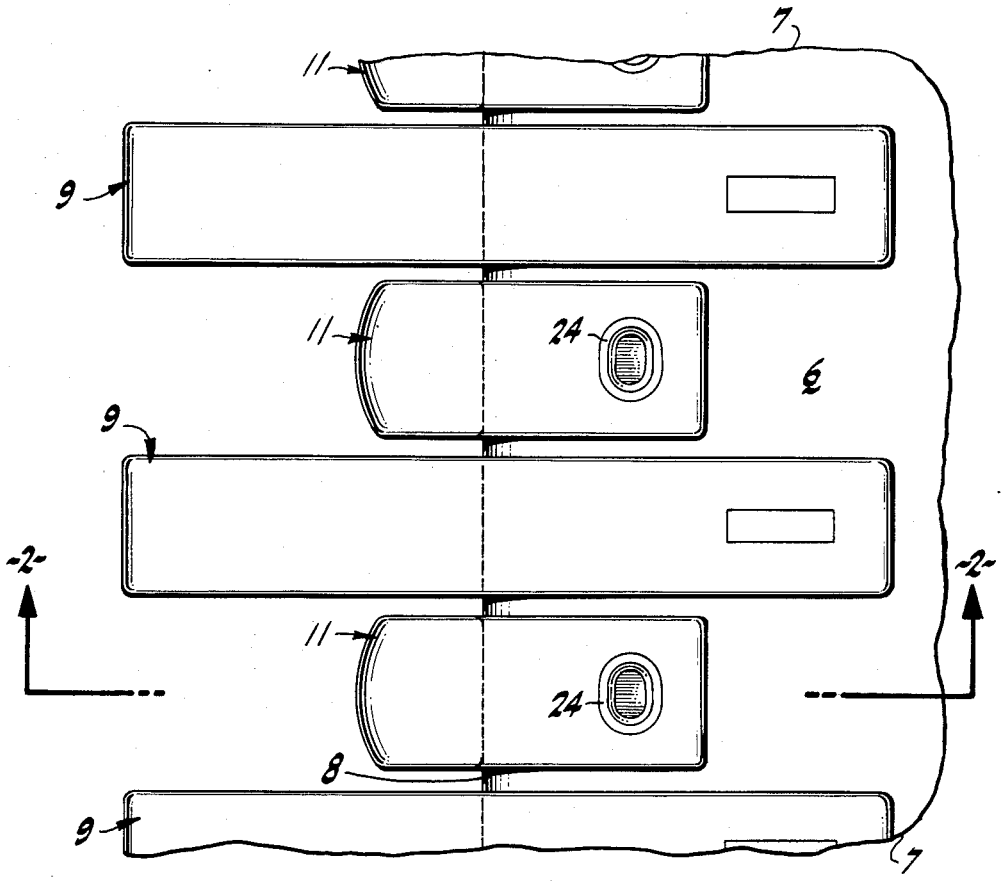
FIG. 1 is a plan of a portion of a digging bucket provided with the customary digging teeth and equipped with the shrouds of this invention, certain portions of the bucket being broken away to reduce the size of the figure.

In the carrying out of various excavating, mining and dredging operations, it is customary to provide a bucket usually of heavy-walled construction and of metal and including a lower generally planar transverse portion 6 that normally is substantially horizontal and that at its sides 7 curves upwardly to provide at least a partial enclosure.

The bucket is characterized by a leading lip 8 on which are mounted a number of digging teeth 9. These are customarily spaced apart across the width of the bucket and project forwardly therefrom a substantial distance. While there are various different constructions of teeth 9, they are only generally illustrated herein, as no particular tooth pattern is required. The spaced mounting of the teeth on the bucket is customary in order that the teeth may dig readily into the material being excavated. Customarily also, such teeth are provided with removable tips or caps since they are subject to very severe wear, and the caps themselves are changed from time to time to preserve digging integrity.

While in some instances no further protection of the bucket is required, in many instances it has been found that the lip 8 in between the various teeth 9 is subject to substantial abrasion, wear and disintegration due to impact of the excavated materials.

To obviate some of this wear and to restore to better working conditions a bucket that has already become worn in the lip area, a shroud 11 is particularly provided in accordance with out invention. A number of such shrouds are afforded, each one being mounted on the bucket lip in between adjacent ones of the digging teeth 9 and sometimes are mounted on the forward edges of the bucket sides, also.

Figure 2:
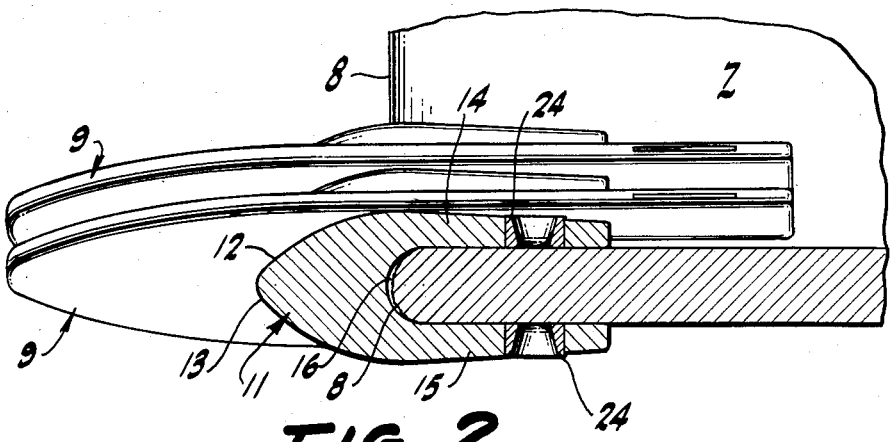
FIG. 2 is a cross-section, the plane of which is indicated by the line 2—2 of FIG. 1.
Figure 3:
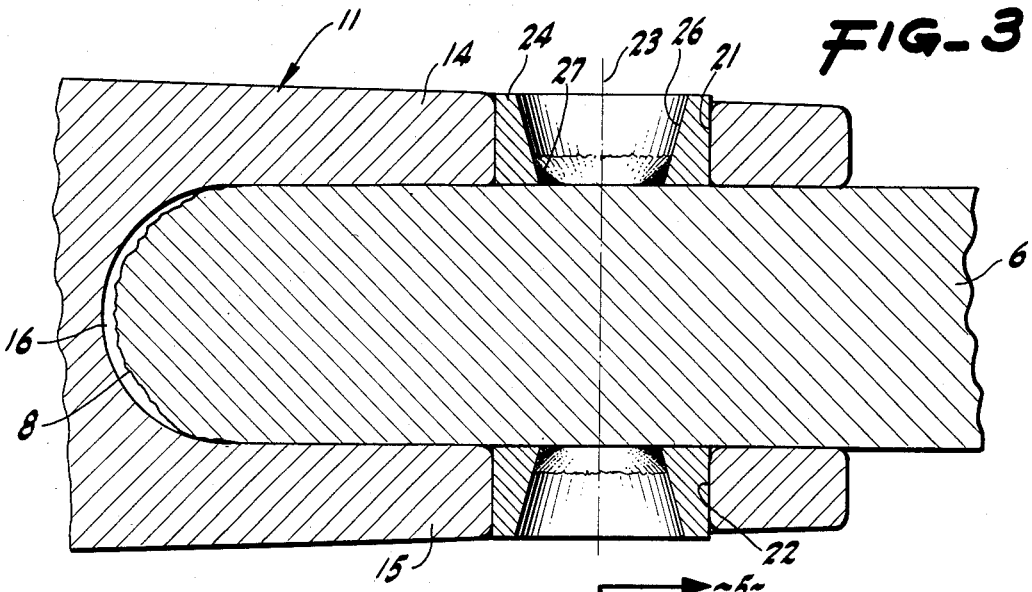
FIG. 3 is an enlargement of a portion of the structure shown in FIG. 2.

Each shroud 11 has a relatively blunt forward portion 12 of a length substantially less that the length of the teeth 9 and of a width something less that the width between adjacent teeth but occupying a fairly large portion of the space therebetween, The shroud 11 is conveniently fabricated of cast high alloy steel and is given a quasi-teardrop shape in longitudinal cross-section substantially as shown in FIG. 2. The shroud has a leading portion 13 which may be somewhat sharper than the remainder of the body and that swells or expands and then diminishes. The shroud is bifurcated to afford a pair of legs 14 and 15 defining a space 16 between them of a dimension to fit over the lip 8 of the bucket. The fit need not be a particularly close one and is perferably looser than a driving fit, so that a shroud easily can be put into position with its legs straddling the forward portion of the lip and centered approximately between the adjacent teeth 9.

Preferably the top and bottom boundaries of the slot between the legs are substantially planar and parallel to each other, just as the outer boundaries of the shroud preferably taper to a lesser thickness toward the rear of the shroud.

Figure 4:
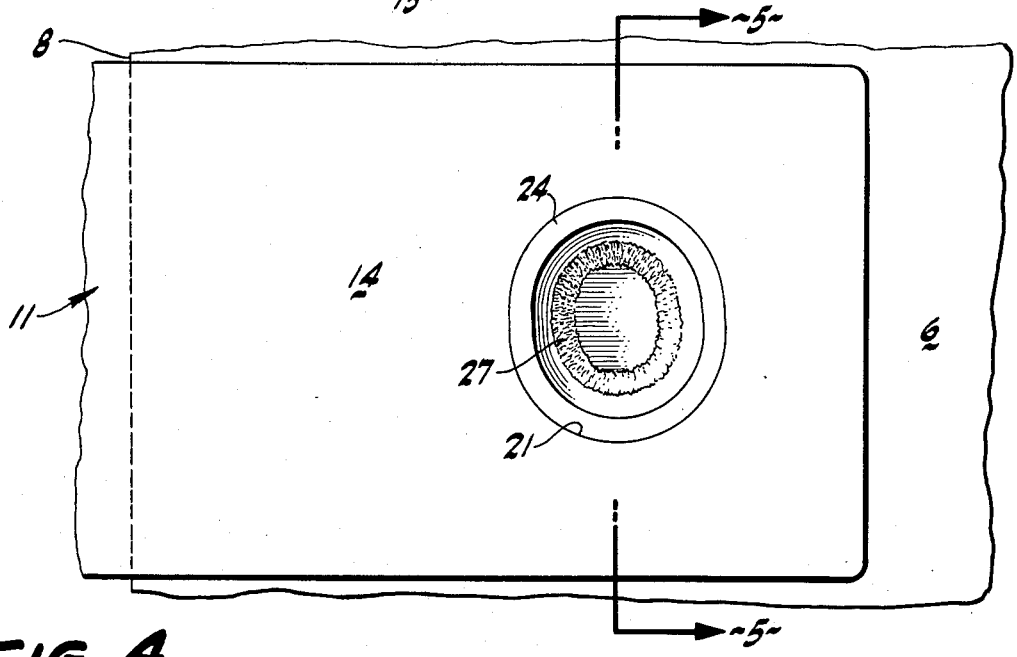
FIG. 4 is a plan of the structure shown in FIG. 3, various portions being broken away.

In especial accordance with the invention, the legs 14 and 15 are provided with openings 21 and 22. The openings usually are made in alignment on a transverse axis 23 (FIG. 4). Each opening is substantially non-circular or elliptical in plan with its long axis extending transversely, as shown in FIG. 4.

Designed to fit into either of the openings is one of a number of rings 24 of a thickness approximately equal to the thickness of the adjacent leg and of a plan contour also elliptical and slightly smaller than the contour of the opening. The ring 24 in cross-section, as shown in FIG. 4, is preferably tapered from a narrow portion adjacent the outside or top to a wide portion adjacent the bottom or lip, so that the inner wall 26 of the ring is tapered. The ring is of a dimension so that it can readily be dropped into the opening 21 and can be moved easily into abutment with the adjacent lip 8. It is not necessary to use any tools or special force to install any of the rings.

After a ring has been put into position in abnutment with the lip and against the sides of the opening 21, it is fastened in place by a bead 27 of weld material securing the ring in position on the lip itself. Normally, no weld is made between the ring and the shroud 11. After both rings for each shroud have been welded into position, it is found in practice that the shroud is well fixed and acts to protect the otherwise exposed leading edge of the lip. The overall performance of the bucket is substantially improved, for a uniform edge is presented and material is well guided.

Figure 5:
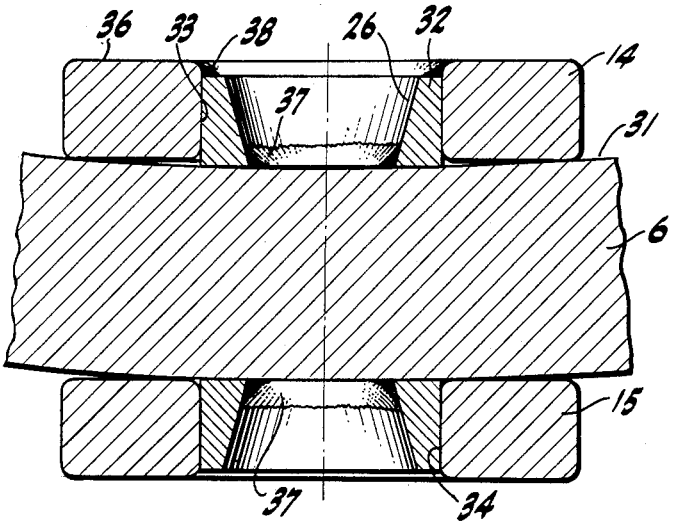
FIG. 5 is a cross-section, the plane of which is indicated by the line 5—5 of FIG. 4.

In some instances even though the bucket lip 31 (FIG. 5) is out of shape or is worn, the positioning of a ring 32 in each of the openings 33 and 34 is an effective positioner. In the event there has been substantial wear of the lip, the rings may not extend entirely to the outside surfaces 36 of the shrouds. Even so, a line 37 of welding is usually sufficient to hold the parts in position, although if desired an additional bead of welding 38 can be afforded.

In installations of this sort, it is found that the transversely elliptical shape of the ring is effective to assist in resisting twisting of the shroud on the bucket lip and affords an increased area of welding over and above a circular interconnection.

In all cases, the addition of the shrouds does not in any way adversely affect the digging ability of the customary teeth 9, but does serve to preclude or make up for undue wear on the intervening portions of the bucket lip, so that an overall improvement in service is afforded.

While there is no size limitation on the shrouds, a representative weight of a shroud cast in low alloy steel is in the range of 250 to 300 pounds.

We claim:

1. A shroud for a solid digging bucket lip having an outer lip surface and an inner lip surface parallel to each other and having a transversely extending leading edge between said lip surfaces comprising a separate shroud body having a forward portion substantially symmetrical about a central plane, a pair of spaced legs integral with and extending rearwardly from said forward portion and parallel to each other, said legs having leg surfaces in positions substantially to abut said outer and said inner lip surfaces and to abut said leading edge, means including a wall defining an aperture through one of said legs between said leg surfaces and open to said lip, a ring having an inner ring surface and an outer ring surface, said ring being slidable in said aperture against said wall and in a direction normal to said plane and into abutment of the end of said ring with said solid bucket lip, and a welding bead on said bucket lip and on and extending around the inside of said inner ring surface and leaving a portion of said bucket lip exposed through said aperture.

2. A shroud as in claim 1 including a pair of walls defining said apertures each disposed in a respective one of said legs and in alignment with each other on opposite sides of said solid lip, and including a pair of said rings each disposed in a respective one of said apertures and in end abutment with said walls and said lip.

3. A shroud as in claim 1 in which each of said apertures and each of said rings is substantially elliptical when considered parallel to said plane.

4. A shroud as in claim 1 in which said ring has an inner wall tapering to a greater thickness toward the end thereof adjacent to said lip.

5. A shroud comprising an integral body having a blunt forward portion and having a rearward portion divided into two legs separated to provide an intervening space, at least one of said legs having an aperture therethrough opening into said space, a ring slidably disposed in said aperture and substantially entirely contained therein, and means for securing the interior end of said ring to a bucket lip disposed in said intervening space extending across and in abutment with said interior end, including a welding bead on said lip and on and shaped like the inside of said ring leaving a portion of said bucket lip exposed through said aperture.

6. A construction for a digging bucket having a generally planar, solid lip comprising an excavating body having a forward portion bifurcated into a pair of parallel legs spaced from each other to receive said lip slidably between them, means defining an aperture through one of said legs, said aperture having its axis substantially normal to said planar lip, and a ring having its ring axis substantially normal to said planar lip, said ring being disposed in said aperture with one end of said ring abutting said solid lip, and a bead of weld material uniting the interior of said end only of said ring and said lip and leaving a portion of said lip within said ring exposed through said ring.

* * * * *